US006854527B2

(12) United States Patent
Manway et al.

(10) Patent No.: US 6,854,527 B2
(45) Date of Patent: Feb. 15, 2005

(54) FRACTURE RESISTANT CARBIDE SNOWPLOW AND GRADER BLADES

(75) Inventors: Terry A. Manway, Monroeville, PA (US); Andrew G. Mayer, Hudson, WI (US); Daniel C. Statler, Greensburg, PA (US); Charles P. Baldwin, Greensburg, PA (US)

(73) Assignee: Kennametal Inc., Latrobe, PA (US)

( * ) Notice: Subject to any disclaimer, the term of this patent is extended or adjusted under 35 U.S.C. 154(b) by 0 days.

(21) Appl. No.: 10/118,435

(22) Filed: Apr. 8, 2002

(65) Prior Publication Data

US 2003/0188463 A1 Oct. 9, 2003

(51) Int. Cl.[7] ..... A01B 15/08

(52) U.S. Cl. ..... 172/719; 172/747; 172/701.1; 37/446; 37/460

(58) Field of Search ..... 172/810, 811, 172/781, 817, 701.3, 701.1, 719, 772.5, 747, 772, 766, 777; 30/353, 355, 357, 351; 37/266, 446, 449, 451, 460

(56) References Cited

U.S. PATENT DOCUMENTS

| | | | | | |
|---|---|---|---|---|---|
| 1,922,917 | A | | 8/1933 | Russell et al. | 37/143 |
| 3,529,677 | A | | 9/1970 | Stephenson | 172/767 |
| 3,790,353 | A | * | 2/1974 | Jackson et al. | 75/236 |
| 3,888,027 | A | | 6/1975 | Toews | 37/141 |
| 3,934,654 | A | | 1/1976 | Stephenson et al. | 172/719 |
| 3,970,445 | A | * | 7/1976 | Gale et al. | 420/64 |
| 3,971,323 | A | | 7/1976 | Beiswenger | 104/10 |
| 3,984,910 | A | | 10/1976 | Helton et al. | 29/420 |
| 4,011,051 | A | * | 3/1977 | Helton et al. | 75/244 |
| 4,024,902 | A | | 5/1977 | Baum | 164/97 |
| 4,052,802 | A | * | 10/1977 | Moen et al. | 37/460 |
| 4,086,966 | A | * | 5/1978 | Lanz et al. | 172/701.3 |
| 4,098,013 | A | * | 7/1978 | Hemphill | 37/453 |

(List continued on next page.)

FOREIGN PATENT DOCUMENTS

| | | |
|---|---|---|
| DE | 2605986 | 8/1977 |
| DE | 3404030 | 4/1985 |
| EP | 0046209 | 8/1982 |

OTHER PUBLICATIONS

ASM Committee on Sintered Carbides, "Sintered Carbides, "Nov. 1978, pp. 659–668.

1978 Databook, Metal Progress, Mid–Jun. 1978, pp. 55, 77, Title Page.

Brochure, "introducing Kengard A grader blades," Kennametal Inc., 8/83, 883–145, 3 pages.

Goetzel, Claus G., "Infiltration" chapter, Metals Handbook Ninth Edition, vol. 7, Powder Metallurgy, American Society for Metals, 1984, pp. 551–566, & title pages.

Brochure, "Kengard A grader blades," Kennametal Inc., WS85–24, 2 pages.

Brochure, "Kennametal snowplow blades and accessories," K nnametal Inc., AM95–17(5)F5, (1995), 6 pages.

*Primary Examiner*—Victor Batson
(74) *Attorney, Agent, or Firm*—Matthew W. Smith

(57) ABSTRACT

The present invention provides for carbide edge snowplow and grader blades that are durable and fracture resistant. The carbide along the blade edge and blade bottom which contacts the surface being treated is designed to limit the degree of fracture of the carbide. Carbide inserts along the edge and/or bottom are separated from each other by a steel alloy spacer/shim along the width of the blade. The spacer/shim reduces the potential for impact damage cracks that form in a carbide insert from propagating into adjacent inserts along the width of the blade. In one embodiment, the improved blade edge comprises an edge body having a lower edge with a recess and separate slot in the bottom surface of the edge. Within the blade recess and blade slot are positioned carbide block/bar inserts separated by spacer means made from a ductile material.

23 Claims, 3 Drawing Sheets

U.S. PATENT DOCUMENTS 4,140,170 A 2/1979 Baum ..... 164/51
4,146,080 A 3/1979 Baum ..... 164/97
4,359,335 A 11/1982 Garner ..... 75/208
4,428,260 A 1/1984 Eby ..... 76/104
4,498,549 A 2/1985 Jurgens ..... 175/329
4,510,706 A * 4/1985 Berchem ..... 37/328
4,576,239 A * 3/1986 Launder ..... 172/751
4,608,318 A 8/1986 Makrides et al. ..... 428/553
4,715,450 A 12/1987 Hallissy et al. ..... 172/701.3
4,744,158 A * 5/1988 Berchem et al. ..... 37/457
4,753,299 A * 6/1988 Meyers ..... 172/777
4,770,253 A 9/1988 Hallissy et al. ..... 172/701.3
4,784,517 A * 11/1988 Bergqvist et al. ..... 404/75
5,054,217 A * 10/1991 Nilsson et al. ..... 37/244
5,067,262 A * 11/1991 Stiffler et al. ..... 37/452
5,129,168 A * 7/1992 Hedley ..... 37/446
5,224,282 A * 7/1993 Swick ..... 37/453
5,224,555 A * 7/1993 Bain et al. ..... 172/772.5
5,427,186 A * 6/1995 Adrian et al. ..... 172/701.3
5,743,032 A * 4/1998 Vauhkonen ..... 37/446
5,743,033 A * 4/1998 Gegel ..... 37/460
5,746,017 A * 5/1998 Marvik ..... 37/446
5,778,572 A * 7/1998 Lukavich et al. ..... 37/460
5,813,474 A 9/1998 Manway ..... 172/701.3
5,881,480 A * 3/1999 Fall ..... 37/460
6,003,617 A * 12/1999 McSweeney et al. ..... 172/719
6,363,633 B1 * 4/2002 Holzer et al. ..... 37/446
6,571,493 B2 * 6/2003 Amano et al. ..... 37/460

* cited by examiner

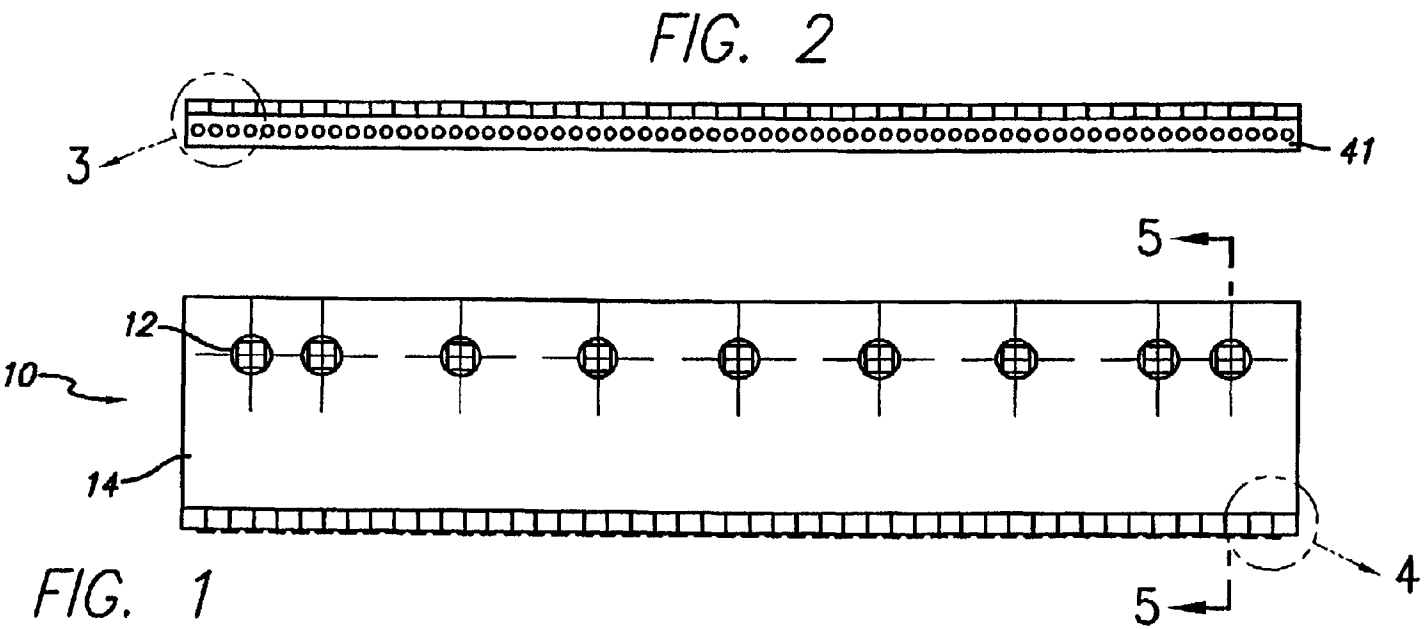
FIG. 2
FIG. 1
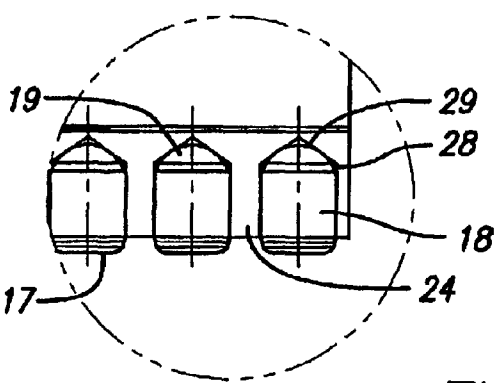
FIG. 4
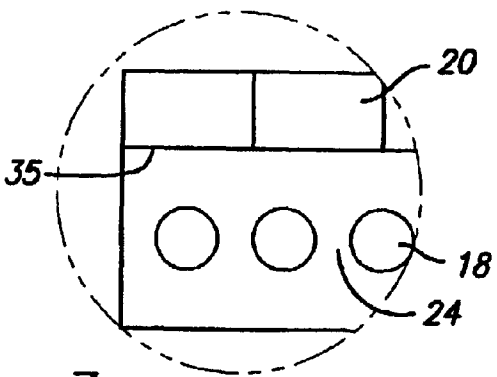
FIG. 3

41
33
10

41

5
5
8
14
16
12
41
10

36
34
20

37
18
34
34
20
35

14
16
28
18
35
41
20

FRACTURE RESISTANT CARBIDE SNOWPLOW AND GRADER BLADES

BACKGROUND OF THE INVENTION

1. Field of the Invention

This invention relates to plow blades for snow plows, earth working devices, and the like, and more particularly to a plow blade having carbide inserts along the bottom forward edge of the plow blade for improved impact and wear resistance.

2. Background

Graders and snowplows are both well known and each has a relatively long moldboard which extends generally laterally of the surface being worked and is moved over the surface in a direction generally perpendicular to the length of the moldboard. Such support members are typically concave on the forward side and adapted for mounting beneath or in front of a power device, such as a truck or tractor. Such plows also typically include a detachable blade which may be attached, typically by bolting, to the lower edge of the support member so as to project downwardly from the support member. Such blades normally withstand most of the impact and abrasive wear to which the plow blade is subjected and as a result are typically made from a quality grade of steel. A lower edge of the blade forms the working surface of the blade.

Grader blades made of steel have the advantage of being relatively inexpensive, but also the disadvantage of wearing out extremely rapidly. Because blade edges are subjected to abrasive wear and impact damage, the wear rate can be extremely high at times. When a blade edge wears down beyond a predetermined point, it must be replaced with another blade edge. The replacement of blade edges is, of course, time consuming, represents down time for the equipment, and requires the maintenance of a replacement parts inventory. If a worn blade edge is not replaced, wear at the lower edge of the blade edge would continue until the support member suffers damage by exposure to the surface being worked on.

Thus, over the years, various techniques, such as impregnation and hardfacing of the blade cutting edge with carbide particles, and attachment of cemented carbide inserts into or onto the blade edge have been employed in attempting to prolong the life of the steel blade.

Blades with cemented carbide inserts, generally referred to as buttons in the industry, have a compact cylindrical shape. These compact inserts are disclosed in U.S. Pat. No. 5,813,474, for instance. The compact insert in FIG. 4 of U.S. Pat. No. 5,813,474 is at one end generally semispherical and at the other end has a blunt stepped section 46. The semispherical section is more resistant to impact damage. In FIG. 2 of '474, a drilled hole in the steel blade body 24 with a compact insert 16 brazed therein is illustrated. As is shown at 38 in U.S. Pat. No. 5,813,474, the bottom of the drilled bore was drilled out by a standard drill bit and is conical. Braze material is placed into the drilled out bores and, next, the compact button is inserted into the bore and then the blade is heated, forming a braze between the compact button and the steel body. The bore does not cooperate with the compact insert like-a-glove, as seen in FIG. 2 of '474. At the bottom of the bore a generally conical space remains after insertion of the compact insert. This remaining conical space is filled with braze material. In this prior art design after the brazing process is complete, voids are much more likely to be present in this conical space in comparison to tight fitting members. Efforts at solving this problem in the industry have included manufacturing the bores with an end mill that forms a cylindrical bore having a flat circular bottom and have been successful in forming a tighter fit between the compact inserts and bores. Although successful in preventing the propensity of voids in the connecting braze, cutting out the bore with an endmill is a much more expensive and more time consuming machining operation in comparison to drilling out the bores with a standard drill.

The use of protruding lane marker reflectors on highways has grown significantly in popularity over recent years. These lane markers are typically attached to the road surface and extend slightly above the road surface. While these reflectors greatly improve lane visibility, they present a problem when the road must be plowed. When typical prior art carbide block/bar inserts within prior art blade edges impact the reflector lane markers, the carbide block/bar inserts, which are more susceptible to impact damage than steel, are sometimes damaged. Furthermore, because such prior art carbide block inserts are typically brazed adjacent to each other, carbide inserts adjacent to the damaged insert are susceptible to crack propagation damage. The same type of damage may also occur when such typical prior art carbide block inserts strike irregularities in the road surface, such as potholes or ruts.

In prior art blades, uniform cemented tungsten carbide bar inserts have been employed on blades to reduce and limit damage to the steel blades. Such blades are disclosed in the sales brochure "Kennametal snowplow blades and accessories" (1995), published by Kennametal Inc., AM95-17(5)F5. The cemented tungsten carbide bars are aligned side by side across the width of the blade. Steel blade edges having cemented wear resistant hard metal carbide block/bar inserts distributed along the lower edge of the blade edge have been employed in an attempt to prolong the life of the blade edge. Other examples of such block/bar inserts are disclosed in U.S. patents to Stephenson et al. (U.S. Pat. No. 3,934,654) and Stephenson (U.S. Pat. No. 3,529,677). The tungsten carbide bars/blocks brazed onto the steel body are positioned side-by-side across the width of the blade and are brazed to each other at their sides. A cemented tungsten carbide bar on these prior art blade designs would sometimes fracture/crack on account of an unusually large impact force. The crack in a cemented tungsten carbide bar of the prior art often was not limited to just a single bar, but would propagate into bars adjacent thereto along large portions of the width of the blade.

Generally speaking, the use of the two sets of tiered cemented tungsten carbide inserts in the bottom edge of a grader blade is known, for instance, in U.S. Pat. No. 4,770,253, to Hallissy et al. The blade in the front recess in Hallissy is made from tungsten carbide having a high cobalt content, 18%–22% cobalt by weight, so as to adapt it for impact wear resistance during use of the grader blade. The intermediate slot contains a second insert composed of cemented tungsten carbide containing 10% to 13% weight percent cobalt. The inserts are brazed to the steel blade body including the intermediate and rear sections thereof. However, in contrast to the construction of the grader blade of the present invention, the prior art Hallissy grader blade has tiered inserts and does not have an independent intermediate slot spaced from the front recess, with the inserts respectively disposed in the recess and the slot. In the present invention the front recess is formed along the forward bottom edge of the blade, whereas the intermediate slot is formed along and opens toward the bottom edge of the blade and is separated from the front recess of the steel blade body. In Hallissy '253 and other prior art, the cemented tungsten carbide bars are brazed together in side-by-side relation. These brazed together tungsten carbide bars function to form a unitary piece of cemented tungsten carbide that spans the width of the blade. If one of the cemented tungsten carbide inserts fractured due to an excessive impact force, a crack would propagate into adjacent carbide inserts across the connecting braze joints.

In the above discussed tiered insert designs, as shown in U.S. Pat. No. 4,770,253, the rearline row of insert bars is brazed into a recess in the steel blade and the frontline of insert bars is brazed onto the rearline row of inserts. The brazing together of the frontline and rearline inserts results in an inherent disadvantage in tiered insert designs. Whenever a front line insert is pried off, for instance by contact with an obstruction on the road whenever the vehicle is placed in reverse, the adjoining rear line insert typically is knocked off together with the front line insert. Not only is the loss of two insert bars of tungsten carbide expensive, the less wear resistant steel portion of the blade becomes exposed.

The use of the two lines of hard material spaced apart from each other along the bottom edge of a grader blade is also known in the prior art, Kengard A grader blade made and sold by Kennametal, see sales brochure "Kengard A grader blades," Kennametal Inc., Latrobe, Pa., publication B84-19(5)A4;B83-145 (1983) discloses spaced hard material inserts. This prior art Kengard A grader blade has a front recess, and an intermediate slot spaced from the front recess, with the inserts respectively disposed in the recess and the slot. The front recess is formed along the forward bottom edge of the blade, whereas the intermediate slot is formed along and opens toward the bottom edge of the blade. The slot is defined between and spaced from the front recess and a rear surface of the blade by intermediate and rear bottom end sections of the steel blade body. The front recess contains a first insert composed of Kengard A material, a metal composite of tungsten carbide particles in a matrix of tough, work-hardening stainless steel. The intermediate slot contains a second line of inserts composed of cemented tungsten carbide containing 10 to 13 weight percent cobalt. The inserts are brazed to the steel blade body. However, the prior art Kengard A grade blade of such construction frequently experienced binder washout between the carbide particles in the composite metal matrix, braze failure due the inherent porosity of the matrix, and overall was not cost effective. The grader blade construction of the present invention eliminates these problems.

While many of these prior art blades would appear to operate reasonably well under the limited range of operating conditions for which they were designed, most seem to embody one or more shortcomings in terms of complexity, performance, reliability and cost effectiveness which make them less than an optimum design. Consequently, a need exists for a different approach to grader blade design, one which will more adequately address the kinds of wear and forces encountered by the lower end of the grader blade.

SUMMARY OF THE INVENTION

The present invention provides a grader blade designed to satisfy the aforementioned needs. The blade of the present invention is based on two sets of cemented carbide principle—the one forward cemented carbide for face wear resistance primarily to impacts and the other rearward cemented carbide for downpressure wear resistance. In particular, the blade of the present invention has a bottom edge with a forward portion thereof incorporating a pair of elongated cemented carbide inserts. A frontline of inserts is composed of, for instance, a cemented carbide composition of high cobalt content adapting it for impact wear resistance and a rear one of compact buttons is composed of, for instance, a cemented carbide composition of lower cobalt content adapting it for downpressure wear resistance.

Another object of the invention is to separate the cemented tungsten carbide block/bar inserts from each other by positioning a steel alloy spacer/shim therebetween, reducing the potential for impact damage cracks formed on the edge of the blade propagating along the width of the blade to other cemented tungsten carbide bars.

In the present invention, the compact inserts have a convex end that is inserted into a bore formed into the steel body of the blade with a standard drill bit. The convex end more closely approximates the conical inner end of the blind bore and significantly lessens the possibility of voids in the braze between the blade steel body and compact insert.

In an alternative embodiment, the improved blade edge comprises an edge body having a lower edge with a recess and separate slot in the bottom surface of the edge. Within the blade recess and blade slot are positioned generally cylindrical inserts separated by notched spacer means made from a ductile material.

These and other advantages and attainments of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

While various embodiments of the invention are illustrated, the particular embodiments shown should not be construed to limit the claims. It is anticipated that various changes and modifications may be made without departing from the scope of this invention.

FIG. 1 is a front view of a blade constructed according to the present invention.

FIG. 2 is bottom view of the blade illustrated in FIG. 1.

FIG. 3 is an enlarged view of the circled section of the blade shown in FIG. 2.

FIG. 4 is an enlarged partial cross sectional view of the one circled section of the blade shown in FIG. 1.

DETAILED DESCRIPTION OF THE EMBODIMENTS

The present invention generally relates to blades for graders, snowplows and the like and, more particularly, is concerned with a grader blade which incorporates a pair of rows of inserts adapting its bottom forward edge for improved impact and downpressure wear resistance.

One embodiment of the plow blade invention is shown in FIGS. 1–5. The plow blade 10 includes a plurality of openings 12 for receiving bolts or other connecting means to fix the blade to the blade support mold. While any suitable bolts may be used, the bolts may be in the form of plow bolts in which the heads are substantially flush with the working side of the blade and provide substantially no obstruction to the sliding of material over the edge front work surface of the blade edge. The use and spacing of such bolts with self-locking nuts are generally known in the art and will not be discussed in further detail here. The blade 10 is connected to a support mold board, having a member front work surface up to 18 feet long or longer and can be mounted beneath or in front of a power device such as a truck or tractor. The configuration of the front surface of a support member may be concave, flat, partially flat and partially concave, or may have any other suitable or desired configuration.

A support member for the blade 10 is typically mounted so that the length of the support member is generally parallel to the surface being worked on and is typically moved along the surface being worked on in a direction generally perpendicular to the length of the support member. Additionally, the support member is typically mounted such that it can be raised and lowered relative to the surface and tilted relative to the surface in the fore and aft direction and also in the lateral direction.

Figures 5, 6, 7, 8, 9, 10:
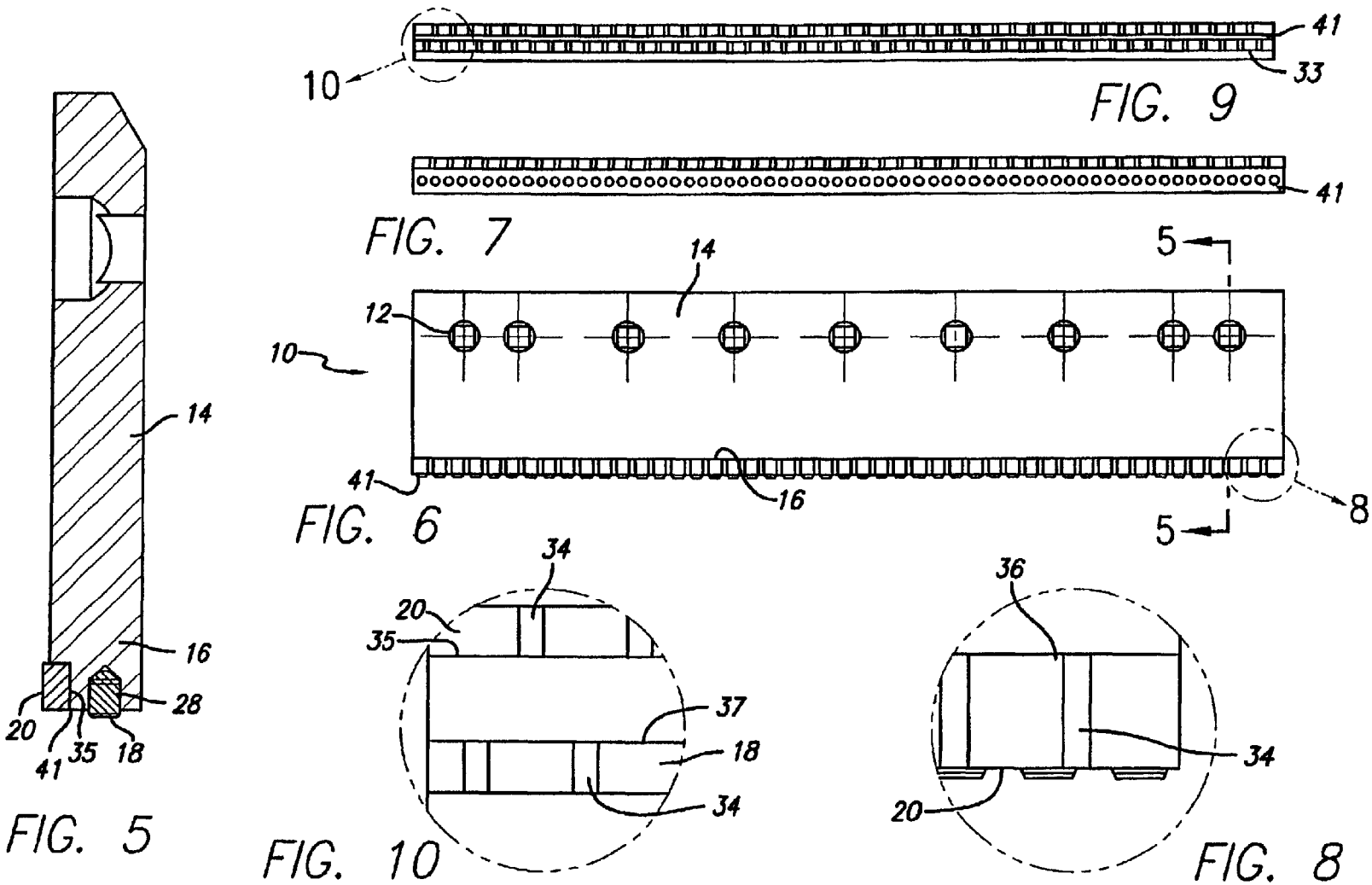
FIG. 5 is a cross-sectional view of the blade taken along lines 5—5 shown in FIG. 1.
FIG. 6 illustrates a front view of second embodiment of the present invention.
FIG. 7 is bottom view of the blade illustrated in FIG. 6.
FIG. 8 is an enlarged view of the circled section of the blade shown in FIG. 6.
FIG. 9 illustrates a bottom view of a third embodiment of the present invention.
FIG. 10 is an enlarged view of the circled section of the blade shown in FIG. 9.

The blade has a steel body section 14 including a blade bottom edge section 16 including a bottom surface 41 generally perpendicular to the front work face of the bottom edge section. The blade body 14 may be made from any appropriate material, such as AISI 1020 to 1045 grade steel or AR 400 steel. The blade bottom edge section 16 in the embodiment illustrated in FIGS. 1–5 has attached thereto a plurality of hard material inserts 18, 20 fixed thereto. The frontline inserts 20 are fixed within a recess 35 as best shown in FIGS. 3 & 5 and the rearline inserts are fixed within a plurality of holes 28. The hard material inserts can be manufactured from cemented tungsten carbide, a diamond composite or other wear-resistant hard materials well-known in the industry. The front line inserts 20 on the forward section of the blade can be made from a different hard material than the rearline inserts. U.S. Pat. Nos. 4,715,253 and 4,715,450, for instance, disclose a frontline of insert bars being made from a cemented tungsten carbide composition with a large amount of cobalt in comparison to the rearline of bar inserts which are formed of cemented tungsten carbide with relatively less cobalt, providing for greater resistance to downward pressure. U.S. Pat. Nos. 4,770,253 and 4,715,450, both to Hallissy et al., are hereby incorporated into the specification in their entirety. Such a combination of hard materials in combination exhibits better durability than selecting just one composition for both the frontline and rearline inserts.

The rearline insert bars positioned into the slot in this prior art design, as discussed above, are made from a cemented tungsten carbide material with a lower percentage of cobalt so as to be more resistant to downward forces which, however, also makes it more brittle and likely to fracture. Fractures in brittle material also have a greater propensity to propagate. These fractures often propagate into and along adjacent bars brazed thereto resulting in catastrophic failure. The inserts on the frontline are made from a tougher, more ductile material with a higher percentage of cobalt in comparison to the rearline inserts and are not as likely to fracture and/or propagate said fracture. Accordingly, the present invention addresses this particular problem with brittle rearline inserts by using generally cylindrical compact inserts 18 for the rearline inserts. In FIG. 4 of the invention the compact inserts 18 are shown positioned in bores 28 drilled in the bottom section 16 of the blade body. In the present invention, the rearline inserts are not brazed together but are separated from each other by sections of the bottom edge section of the steel body 14. In the present invention, whenever a fracture occurs in a rearline insert 18, a crack will not propagate into the next closest rearline insert. The crack will dissipate at the boundary between the bottom edge section 16 of the steel body 14 and rearline insert 18. The steel body 14 is made of a ductile steel alloy material that is less brittle than the hard material used for the rearline inserts 18, generally cemented tungsten carbide with a low percentage of cobalt.

The bore 28 is formed by a standard drill bit creating a bore with a conical tip 29 at its most inner end 29. While the insert holes may have any suitable configuration, the insert holes 28 in this embodiment have a generally cylindrical configuration, the typical shape in the industry. Accordingly, the hard material inserts may have any suitable configuration so long as the shape of the insert hole and hard material insert generally correspond in shape and size.

The semispherical end 19 of the rearline insert 18 is placed into the bore, in reverse fashion to the manner in which the insert is fitted into the bore in U.S. Pat. No. 5,813,474. The semispherical portion 19 more closely approximates the inner conical end 29 of the bore. The closer fit lessens the possibility of voids in the braze between the blade and inserts. While not shown, the end 19 could alternatively constitute a paraboloid, an ellipsoid or other convex configuration that more accurately approximates the inner end drill point configuration 29 of the hole. The exterior blunt end 17 of the rearline insert, it is admitted, is less resistant to impact damage than an insert having an exterior end that is convex. However, such prior art insert designs with an exterior end having a convex surface, as illustrated in U.S. Pat. No. 5,813,474, quickly flatten during blade use and become similar in shape to the exterior end 17 of the present invention.

In addition to the benefit of reducing voids in the braze by placing the convex end of the insert into the hole, an added benefit in assembly is also achieved. During assembly, it is easier for a person to position the semispherical end of the compact insert into the bore than attempting to place the blunter opposite end of the compact insert into the hole. The semispherical shape of the hard material insert helps self-center itself as it is manually positioned into the bore for brazing. In contrast to positioning the blunt end of the insert into the bore, see U.S. Pat. No. 5,813,474, which requires more precise manual alignment of the compact insert with the hole before it can be inserted into the hole.

FIGS. 6–8 illustrate a second embodiment of the invention. As shown in FIG. 7, the rearline inserts are generally cylindrical compact inserts 18 that are placed and brazed into cylindrical bores formed into the bottom edge of the steel body. The frontline inserts 20 in the second embodiment are not however directly brazed to each other as in the first embodiment. The tungsten carbide insert bars 20 are spaced from each other by steel body spacer means 34. Spacer means 34 and frontline insert bars 20 are brazed together in recess 35 at the very bottom corner of the front face and bottom edge of the blade 10. The spacer means 34 are made from a ductile steel alloy similar to the blade. The ductile spacer means 34 prevent crack propagation along inserts 20. Any fracture to an insert is limited by the ductile steel spacer means and does not propagate beyond the boundary 36 formed at the interface between a spacer means and frontline insert.

FIGS. 9–10 disclose a third embodiment of the invention. In the third embodiment, both the frontline inserts 20 and rearline inserts 18 are cemented tungsten carbide bars separated by spacer means 34. The spacer means 34 and bar inserts 20 are positioned in the recess 35 and brazed therein. Similarly, spacer means 34 and rearline bar inserts 18 are positioned inside a uniform slot 37 having a flat inward surface parallel to the bottom surface 41 of the blade, the slot 37 that spans the width of the blade and brazed therein. The center of the rearline insert bars is positioned directly behind the spacer means 34 in the frontline. It is believed that such an arrangement is likely to assist in reducing undesirable washout, as discussed below with respect to a similar embodiment shown in FIGS. 11–14.

FIGS. 11–14 and 16 illustrate a fourth embodiment of the invention. In the fourth embodiment of the invention, generally cylindrical compact inserts are employed for both the frontline inserts 120 and the rearline inserts 118. Spacer means 134 having semispherical notches at both ends are adapted to receive the inserts 118 and 120. The tungsten carbide insert bars 120 are spaced from each other by steel body spacer means 134. Spacer means 134 and frontline cylindrical inserts 120 are positioned in a recess 135 at the bottom of the front work face that forms a corner with the bottom edge of the blade 110 and brazed together onto the blade steel body 114.

Figures 11, 12, 13, 14, 15, 16:
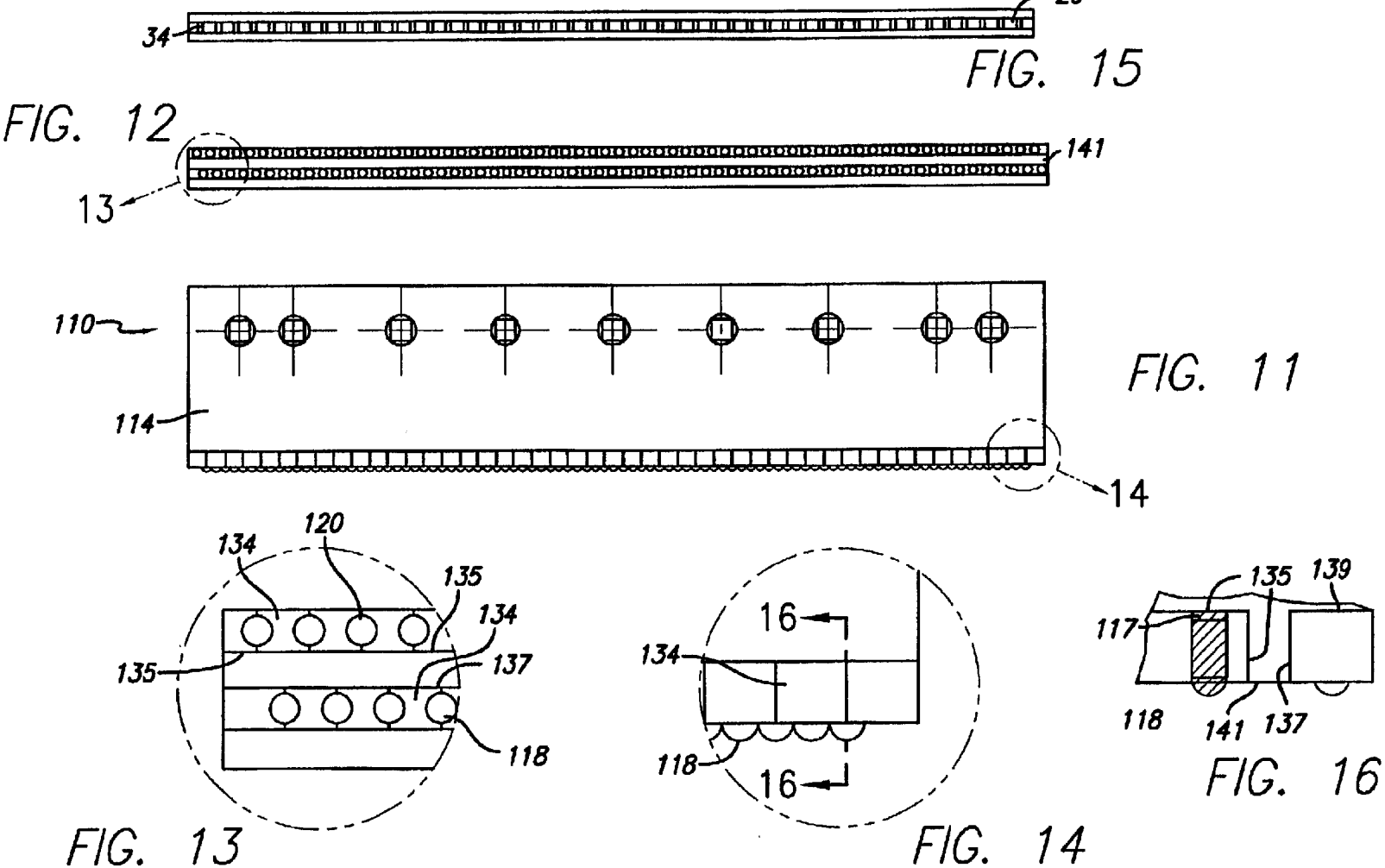
FIG. 11 illustrates a front view of a fourth embodiment of the present invention.
FIG. 12 is bottom view of the blade illustrated in FIG. 11.
FIG. 13 is an enlarged view of the circled section of the blade shown in FIG. 12.
FIG. 14 is an enlarged view of the one circled section of the blade shown in FIG. 11.
FIG. 15 illustrates a bottom view of a fifth embodiment of the present invention.
FIG. 16 is a cross-sectional view taken along lines 16—16 in FIG. 14.

The uniform slot 137 and recess 135, as illustrated in FIG. 16, both have a flat inward surface 138 parallel to the bottom surface 141 of the blade that spans the width of the bottom edge of the blade steel body. The spacer means 134 and inserts 118 are inserted within the slot 137 and recess 135. The spacer means 134 and rearline cylindrical inserts 120 are positioned and brazed together into the slot 137 or recess 135. This assembly method of placing inserts and spacer means into a slot and/or recess that spans the width of the blade is less expensive than drilling blind holes and manually inserting rearline cylindrical inserts into each bore.

An additional benefit to this method of assembly is that the compact inserts are not inserted into drilled out blind holes, but along with the spacers are placed into a slot having a flat horizontal inward bottom surface as illustrated in FIG. 16. The blunt end 117 of the insert 118 can be placed into the slot or recess into cooperation with the flat horizontal inward surfaces 138/139. The blunt end 117 of the insert forms better contact with a flat inward surface 138/139 than the blunt surface does with the prior art inward conical shape of drilled out blind bores as discussed above. This more closely corresponding fit enables for improved brazing and precludes the braze void problem with drilled out blind bores. In this embodiment it is not necessary to reverse the orientation of the cylindrical compact insert 18 as discussed above to preclude voids. Accordingly, the convex 19 portion of the insert 18 can be oriented outward for improved impact resistance.

The frontline inserts 120 are uniformly spaced apart along the width of the blade. Gaps of uniform size accordingly span the width of the blade. During operation of the blade, material/snow flows around the inserts through the gaps, causing the steel body material within the gaps to wear "wash out" at a greater rate than accompanying steel on the bottom surface of the blade. The rearline inserts 118 are centrally positioned to help plug these high flow areas and redisperse the material/snow flow helping reduce accelerated "wash out."

FIG. 15 shows a fifth embodiment of the invention that has only one row of hard material wear inserts across the width of the blade. The embodiment shown in FIG. 15, similar to the embodiments shown in FIGS. 7 and 9, includes hard material insert bars 20. The insert bars 20 are spaced from each other by steel body spacer means 34. Similar to the embodiment discussed above, the ductile spacer means 34 prevent crack propagation along inserts 20. In addition, such a design is easier to manufacture and assemble than the single row compact insert blade shown in U.S. Pat. No. 5,813,474. The design shown in U.S. Pat. No. 5,813,479 requires more extensive machining and tooling to form the plurality of holes for receiving the compact inserts. The compact inserts in such a single row blade can be made from a cemented metal carbide, such as tungsten carbide, of a tough grade used in prior art blade designs. More specifically, the inserts 16 are believed suitable if made from a high shock WC grade of tungsten carbide having an 11% to 12.5% cobalt content. U.S. Pat. No. 5,813,474 is herein incorporated in its entirety.

In the prior art, cemented tungsten carbide bars that are positioned side-by-side with only braze separating them function to form a unitary piece of cemented tungsten carbide that spans the width of the blade. The embodiment of the present invention incorporates hard material inserts that are separated by ductile steel alloys and then brazed together. The ductile spacer means between the hard inserts minimizes the potential for damage to the blade by isolating fractures.

While particular embodiments of the invention have been illustrated and described, it will be obvious to those skilled in the art that various changes and modifications may be made without departing from this invention. It is intended that the following claims cover all such modifications and all equivalents that fall within the spirit of this invention.

All patents and patent applications cited herein are hereby incorporated by reference in their entirety.

It is thought that the grader blade of the present invention and many of its attendant advantages will be understood from the foregoing description and it will be apparent that various changes may be made in the form, construction and arrangement of the parts and steps thereof without departing from the spirit and scope of the invention or sacrificing all of its material advantages, the form hereinbefore described being merely a preferred or exemplary embodiment thereof.

What is claimed is:

1. A blade for attachment to a moldboard comprising: a bottom edge section, wherein said bottom edge section includes front work face and a bottom surface, said front work face and said bottom surface forming a corner, said front face having a recess formed along said corner, and said bottom surface having a slot spaced apart from said recess, wherein a plurality of hard inserts is fixed in a frontline row within said recess, a plurality of hard inserts is fixed in a rearline row within said slot, and each said insert is separated by a spacer means made from a ductile grade of material to prevent propagation of impact fractures along each said row of said hard inserts.

2. The blade for attachment to a moldboard according to claim 1 wherein said hard inserts within one of said rows are generally cylindrical.

3. The blade for attachment to a moldboard according to claim 1 wherein said hard inserts within one of said rows are generally block or bar shaped.

4. The blade for attachment to a moldboard according to claim 1 wherein said hard inserts are generally block or bar shaped.

5. The blade for attachment to a moldboard according to claim 1 wherein said hard inserts are generally cylindrical.

6. The blade for attachment to a moldboard according to claim 5 wherein an exterior end of said hard inserts is convex.

7. The blade for attachment to a moldboard according to claim 1 wherein said slot has a flat inward surface, and said hard inserts are generally cylindrical.

8. The blade for attachment to a moldboard according to claim 7 wherein an end of said hard insert is generally flat and contacts said flat inward surface of said slot.

9. The blade for attachment to a moldboard according to claim 1 wherein said recess has a flat inward surface, and said hard inserts are generally cylindrical.

10. The blade for attachment to a moldboard according to claim 7 wherein an end of said hard insert is generally flat and contacts said flat inward surface of said recess.

11. A blade for attachment to a moldboard comprising:

a bottom edge section, said bottom edge section includes a plurality of drilled blind holes having an inward conical section, a plurality of generally cylindrical hard inserts having a flat blunt end and an opposite convex end, wherein said convex end of said inserts is placed into said blind holes and said blunt end extends outward from said bottom edge.

12. The blade for attachment to a moldboard according to claim 11 wherein said hard inserts are brazed inside said blind holes.

13. The blade for attachment to a moldboard according to claim 12 further comprising:

a plurality of hard inserts having a block or bar shape and corresponding spacer means, said bottom edge section has a recess, said block or bar shaped hard inserts and spacer means are fixed within said recess.

14. The blade for attachment to a moldboard according to claim 11 wherein said cylindrical hard inserts are arranged in a row.

15. The blade for attachment to a moldboard according to claim 14 wherein said row spans the width of the blade.

16. A blade for attachment to a moldboard comprising:

a bottom edge section having a width dimension, said bottom edge section includes a plurality of rows of generally cylindrical hard inserts, each row having spacer means separating adjacent cylindrical inserts, said cylindrical inserts extend beyond a bottom surface of said bottom edge section and are uniformly spaced across the width of said blade, said uniform spacing of said cylindrical inserts results in uniform gaps across said width of said bottom edge, wherein said plurality of rows of hard inserts includes a frontline row and a rearline row, said rearline row of inserts positioned in said gaps to assist in redispersing material flow through said gap.

17. The blade for attachment to a moldboard according to claim 16 wherein said cylindrical inserts in said rearline row are centrally positioned in said gaps.

18. A blade for attachment to a moldboard comprising:

a bottom edge section, said bottom edge section includes a plurality of drilled blind holes and a recess, a plurality of generally cylindrical hard inserts, a plurality of hard inserts shaped as a block or bar, wherein said cylindrical inserts are fixed into said blind holes and said block/bar inserts are fixed within said recess.

19. The blade for attachment to a moldboard according to claim 18 wherein said cylindrical inserts and block/bar inserts are brazed to said bottom edge section.

20. The blade for attachment to a moldboard according to claim 19 wherein said block/bar inserts form a frontline row and said cylindrical inserts form a rearline row.

21. The blade for attachment to a moldboard according to claim 18 wherein spacer means are positioned between each of said block/bar inserts.

22. The blade for attachment to a moldboard according to claim 20 wherein said frontline inserts are made from a more ductile material than said rearline inserts.

23. The blade for attachment to a moldboard according to claim 22 wherein said frontline inserts and rearline inserts are made from tungsten carbide.

* * * * *